US007662754B2

(12) United States Patent
Faure et al.

(10) Patent No.: US 7,662,754 B2
(45) Date of Patent: Feb. 16, 2010

(54) COMPOSITION, FOAM AND PROCESS FOR THE DECONTAMINATION OF SURFACES

(75) Inventors: Sylvain Faure, St. Dicker (FR); Bruno Fournel, Bagnols/Lbe (FR); Paul Fuentes, Manosque (FR)

(73) Assignee: Commissariat a l'Energie Atomique, Paris (FR)

( * ) Notice: Subject to any disclaimer, the term of this patent is extended or adjusted under 35 U.S.C. 154(b) by 275 days.

(21) Appl. No.: 10/520,438

(22) PCT Filed: Jul. 4, 2003

(86) PCT No.: PCT/FR03/02078

§ 371 (c)(1),
(2), (4) Date: Jan. 26, 2006

(87) PCT Pub. No.: WO2004/008463

PCT Pub. Date: Jan. 22, 2004

(65) Prior Publication Data

US 2006/0211592 A1 Sep. 21, 2006

(30) Foreign Application Priority Data

Jul. 8, 2002 (FR) ..... 02 08537

(51) Int. Cl.
*G21F 9/00* (2006.01)

(52) U.S. Cl. ..... 507/213; 588/18; 134/42

(58) Field of Classification Search ..... 507/213; 588/18; 134/42

See application file for complete search history.

(56) References Cited

U.S. PATENT DOCUMENTS 4,349,443 A * 9/1982 Block ..... 507/124
4,366,070 A * 12/1982 Block ..... 507/114
4,428,845 A * 1/1984 Block ..... 507/124
4,473,479 A * 9/1984 Block ..... 507/114
5,093,073 A * 3/1992 Schenker ..... 376/310
5,421,897 A * 6/1995 Grawe ..... 134/6
5,670,469 A * 9/1997 Dingus et al. ..... 510/274
5,817,186 A * 10/1998 D'Muhala et al. ..... 134/40
6,336,977 B1 1/2002 Menke et al.
6,475,296 B1 * 11/2002 Gauchon et al. ..... 134/40
6,509,176 B1 * 1/2003 Cantiani et al. ..... 435/101
6,561,200 B1 * 5/2003 Fournel et al. ..... 134/22.19
7,078,198 B1 * 7/2006 Vaslin et al. ..... 435/101
2002/0039984 A1 * 4/2002 Ketelson et al. ..... 510/247

FOREIGN PATENT DOCUMENTS

EP 0526305 2/1993

(Continued)

*Primary Examiner*—Gregory E Webb
(74) *Attorney, Agent, or Firm*—McKenna Long & Aldridge LLP

(57) ABSTRACT

The invention relates to a composition which makes it possible to obtain a gelled aqueous foam capable of decontaminating, stripping or degreasing a surface. The composition of the present invention comprises one or more surfactants, one or more acidic or basic reactants and a gelling agent.

The decontamination foam obtained from this composition exhibits long lifetimes, generally of between 1 and 10 hours, guaranteeing a prolonged time of action on the surface and a high decontamination effectiveness. These foams can be used to remove the radioactivity from an inaccessible plant, which is large in size and complex in design, by simple filling or by simple spraying over an accessible surface.

16 Claims, 3 Drawing Sheets

FOREIGN PATENT DOCUMENTS

| | | |
|---|---|---|
| FR | 2389668 | 12/1978 |
| FR | 2775606 | 9/1999 |
| FR | 2798603 | 3/2001 |
| JP | 07113099 A | 5/1995 |
| JP | 07233395 A | 9/1995 |
| WO | WO 97/45510 | 12/1997 |

* cited by examiner

COMPOSITION, FOAM AND PROCESS FOR THE DECONTAMINATION OF SURFACES

This application is a national phase application of PCT Application No. PCT/FR03/002078 filed Jul. 4, 2003, which claims the benefit of French Patent Application No. 02/08537, filed Jul. 8, 2002. which are both hereby incorporated by reference.

A subject-matter of the present invention is a decontamination composition, solution and foam. The composition and the solution of the present invention make it possible to obtain an acidic or basic gelled aqueous foam which can be used to decontaminate surfaces.

The present invention finds, for example, application in the decontamination of metal surfaces contaminated, for example, by grease, by irradiating inorganic deposits, by a highly adherent oxide layer or in the body of the material.

It is very particularly of great advantage in radioactive decontamination, for example of large-scale nuclear plants of complex design or which are inaccessible, for which economy with regard to chemical reactants and liquid effluents used is necessary. For example, it is difficult to decontaminate the inside of large-scale tanks, for example of 20 to 100 $m^3$, or plants for the reprocessing of spent fuel comprising solutions of fission products as the medium is a highly irradiating one.

Specifically, the dose rate can reach up to 40 GyH at the bottom of the tank, at a depth of 7.5 m. This level of irradiation prohibits virtually any modification of the existing fittings of the tank. In addition, the presence of numerous cooling coils in the vessels does not allow the introduction of devices for the application of the decontamination treatments. Finally, the contaminated fluid cannot be extracted from the vessels with a view to recycling the foam without very expensive additional facilities. The existing transfer means and discharge lines for the fluids have therefore to be used.

PRIOR ART

Numerous compositions and foams intended for surface treatments, in particular for cleaning, degreasing and/or radioactive decontamination treatments of surfaces, have been developed. Unfortunately, they all exhibit the same disadvantages: they have lifetimes which are too short and difficult to control. This is because the foams of the prior art rapidly drain, in a few minutes, and exhibit a lifetime, defined as the time necessary for the complete conversion of a given volume of foam to liquid, generally ranging from 1 to 10 minutes.

This often means that, to ensure the effectiveness of the treatment, it is necessary to apply the foam repeatedly to the surface to be treated. The amount of cleaning effluents and the difficulty of the treatment are therefore enhanced.

In addition, as the duration of contact of the foam with the surface is limited as a result of the short lifetime of the foams, the cleaning and treatment agents used often have to be chosen so as to be highly active over a very reduced time. Only high concentrations of products, or more corrosive products, can therefore be used.

This limits the type of surface which it is possible to treat and results in greater pollution, increased difficulties in rinsing the surfaces and an increase in the cost of the treatment.

There thus exists a real need for a foaming composition which makes it possible to overcome the disadvantages of the compositions of the prior art, that is to say which makes it possible in particular to prolong and to control the lifetime of the foam, to reduce the amount of effluents, to use less corrosive cleaning agents, to use these agents at a reduced concentration, and to reduce the difficulty, the pollution and the cost of the treatment.

ACCOUNT OF THE INVENTION

The purpose of the present invention is specifically to solve the numerous problems of the prior art by providing a composition intended to prepare an aqueous foaming solution which makes it possible to generate a foam which does not exhibit the disadvantages of the prior art.

The composition of the present invention comprises:

- a foaming organic surface-active agent or a mixture of foaming surface-active agents,
- a gelling agent and, optionally,
- a decontaminating agent.

The foams generated from the composition of the present invention thus comprise a gelling agent. This is because, unexpectedly, the lifetime of this foam is greatly increased in comparison with the foams of the prior art and the foam thus prepared exhibits a markedly improved ability, in comparison with the foams of the prior art, to remain in contact with a surface, even a vertical surface, for several hours, thus making it possible to provide for the decontamination of the said surface statically or in spray mode. This unexpected result leads to greater effectiveness of the treatment of the surface, if appropriate with reduced concentrations of decontaminating agents, for example cleaning, degreasing or decontaminating agents, and a reduction in the amount of effluents produced. In addition, it is possible to use active decontaminating agents which are less corrosive than those of the prior art owing to the fact that the contact of the foam of the present invention with the surface to be treated is prolonged.

Advantageously, the composition of the present invention is an aqueous solution which comprises, per liter of solution:

- 0.2 to 2% by weight of a foaming organic surface-active agent or of a mixture of foaming surface-active agents,
- from 0.1 to 1.5% by weight of a gelling agent and, optionally,
- 0.2 to 7 mol of a decontaminating agent.

This solution can be prepared very easily, for example at ambient temperature, by adding the surfactant or surfactants, the gelling agent and, if it is of use, the decontaminating agent of the composition of the present invention to an aqueous solution, for example water, with simple mixing.

According to the present invention, the gelling agent is preferably biodegradable. It is advantageously an organic thickening agent exhibiting a Theological behaviour of pseudoplastic type. According to the invention, the gelling agent can be chosen, for example, from the group consisting of a water-soluble polymer, a hydrocolloid and a heteropolysaccharide chosen, for example, from the family of the polyglucoside polymers comprising trisaccharide branched chains, such as xanthan gum, for example, Rhodopol 23 (trade mark) sold by Rhodia. It can also be chosen from the group consisting of cellulose derivatives, such as carboxymethylcellulose or a polysaccharide comprising glucose as sole monomer, for example Amigel (trade mark) sold by Alban Muller International.

According to the invention, the surface-active agent can be a foaming nonionic surfactant chosen, for example, from the family of the alkylpolyglucosides or alkylpolyetherglucosides. These surfactants are derivatives of natural glucose and exhibit the advantage of being biodegradable. Mention may in particular be made, by way of example, of the surfactants "Oramix CG-110" (trade mark) sold by Seppic or "Glucopon 215" (trade mark) sold by AMI.

According to the invention, the surface-active agent can be an amphoteric surfactant chosen, for example, from the family of the sulphobetaines, from the family of the alkyl amidopropyl hydroxysulphobetaines, for example Amonyl 675 SB (trade mark) sold by Seppic, or from the family of the amine oxides, for example Aromox MCD-W (trade mark) or the cocodimethylamine oxide sold by Akzo Nobel.

The composition of the present invention can comprise a single surfactant or a mixture of surfactants chosen, for example, from the abovementioned families.

The composition of the present invention is presented mainly as a composition which makes it possible to generate a foam for the decontamination of a surface. Of course, the present invention also covers any composition which makes it possible to generate a foam, whatever its use, provided that it comprises a surface-active agent and a gelling agent.

For example, the composition of the present invention can also be a composition comprising only these last two components and intended to prepare a rinsing foam or alternatively a composition additionally comprising a surface-treatment agent and intended to prepare a surface-treatment foam. The surface-treatment agent can, for example, be an antioxidant, an antiseptic, and the like.

The decontaminating agent, when it is present, is chosen according to the use for which the composition is intended. When the composition is intended to generate a decontamination foam, the active agent is chosen in particular as a function of the nature of the contamination and of the surface to be decontaminated, for example an acid or a mixture of acids, a base or a mixture of bases, an oxidizing agent, for example $H_2O_2$, a reducing agent, a disinfectant, and the like. A person skilled in the art will know how to choose the decontaminating agent according to his requirements.

According to the invention, the active decontaminating agent can be an acid or a mixture of acids, for example inorganic, advantageously chosen from the group consisting of hydrochloric acid, nitric acid, sulphuric acid, phosphoric acid and oxalic acid. According to the invention, the acid is advantageously present at a concentration of 0.2 to 7 mol, preferably of 0.3 to 7 mol, more preferably of 1 to 4 mol. These concentration ranges relate, of course, to the concentration of $H^+$ ions. In addition, they are given for the preparation of 1 liter of foaming solution. They thus represent the concentration in mol/l in 1 liter of foaming solution prepared from this composition.

According to the invention, the active decontaminating agent can be a base or a mixture of bases, for example inorganic, advantageously chosen from the group comprising sodium hydroxide, potassium hydroxide, sodium carbonate, and the like. According to the invention, the base is advantageously present at a concentration of less than 2 $mol.l^{-1}$, preferably ranging from 0.5 to 1.5 $mol.l^{-1}$. These concentration ranges relate, of course, to the concentration of $OH^-$ ions. In addition, they are given for the preparation of 1 liter of foaming solution. They thus represent the concentration in mol/l in 1 liter of foaming solution prepared from this composition.

Thus, depending on the abovementioned composition chosen in accordance with the present invention, an acidic or alkaline foam may exhibit either properties of dissolution of irradiating radioactive deposits, for example for the removal of contaminating materials not attached to the surface, or properties of controlled corrosion of the surface for a contaminating material fixed to the latter.

Advantageously, the composition of the present invention exhibits a viscosity at 0.3 rpm (Brookfield LVT, module x) of between 100 and 50 000 cP. This is because this viscosity makes it possible for the foam to have a prolonged lifetime and also makes possible the possibility of spraying this solution using a nozzle or of passing it through a porous packing to generate a foam.

The foam can be generated from this foaming solution by any system for the generation of foam of the prior art: mechanical stirring, sparging, bead static mixer or any other device which provides gas-liquid mixing, such as the devices disclosed in FR-A-2 817 170, or then a device using a spray nozzle, and the like.

The foam generated can act statically, it has a long lifetime, generally of between 1 and 10 hours, and makes possible a controlled duration of action on the surface as a result of the control of the drainage time by virtue of the gelling agent.

The present invention also relates to a process for the decontamination of a surface comprising a stage consisting in bringing the surface to be decontaminated into contact with a foam prepared from the composition of the present invention, that is to say with a foaming solution in accordance with the present invention.

The invention relates generally to the treatment, in particular to the decontamination, of surfaces of any type, for example of glass, plastic, metals, and the like, which may be large and which are not necessarily horizontal but which can be inclined or even vertical. It can be used, for example, to decontaminate tanks, ventilation conduits, storage pools, glove boxes, steam generators, pipes, floors, and the like.

The decontamination foams can be used both in the context of the periodic maintenance of existing industrial plants and in the context of the dismantling of such plants. These plants can, for example, be nuclear plants or chemical industry plants in general.

The foam can be brought into contact with the surface to be treated by conventional processes for filling, for example, a tank, a vessel or a pipe, the walls of which are to be decontaminated; for spraying onto the surface to be decontaminated; for circulating the foam in a plant, the surfaces of which are to be decontaminated; and the like.

For example, the foam can be applied to the surface to be decontaminated by any conventional process for spraying by means of a pump and of a nozzle. For the spraying, the break-up of the jet of foam over the surface to be decontaminated can be obtained, for example, with a flat jet or round jet nozzle. The short time for recovery of the viscosity of the composition of the present invention allows the sprayed foam to adhere for a sufficiently long time to the surface onto which the foam is sprayed.

For example, to decontaminate a tank, the process of the present invention can consist simply in filling the tank with the foam of the present invention in order for its surfaces to be in contact with the foam. The foam then naturally decomposes "statically" under the effect of its gravitational drainage. The term "static" is then in contrast to the dynamic application of the foams, consisting of circulating or spraying. The foam can also be applied solely to the surfaces of the tank without necessarily filling it.

Consequently, another subject-matter of the invention is a process for the decontamination of a plant which comprises the simple introduction of the foam by simple filling inside the plant, the "static" maintenance of this foam inside the space, for example at a temperature of between 20° C. and 50° C., during the drainage time of the foam, generally between 1 and 10 hours and sufficient to guarantee the decontamination, and then, finally, the removal of the drained liquid simply by emptying.

The decontamination treatment of the surface can consist of several applications of the same foam or with foams of different natures applied successively. Each of these treatments can comprise filling the space to be decontaminated or spraying the foam over a surface, statically maintaining the foam for several hours during its draining and removing the drained liquid simply by emptying. However, the inventors have noted that, as a result of the longer lifetime of the foam of the present invention than that of the foams of the prior art, a reduced number of applications, indeed even a single application, is sufficient to obtain effective treatment of a surface where several applications were necessary with the foams of the prior art.

The duration of the contacting operation will depend essentially on the nature of the decontamination, on the composition and on the nature of the foam, and on the nature of the surface. Generally, a duration of the contacting operation which can range from 15 minutes to 10 hours is sufficient for an effective treatment. This duration will be adjusted according to requirements in the application made of the present invention.

The present invention guarantees an effective treatment, in particular an effective decontamination, owing to the fact that the lifetime of the foam, and thus the contact time of the foam with the wall, is increased and adjusted by the addition of the gelling agent, which slows down the draining. In addition, on vertical surfaces or even roofs, the foams of the present invention, as a result of the presence of the gelling agent, adhere better than the foams of the prior art, which further increases the treatment or decontamination effectiveness on these surfaces.

The drained liquid obtained at the end of the life of the foam of the present invention can be easily discharged by emptying and can be treated by conventional procedures for decontaminating liquid effluents. It can also be regenerated, for example in the way disclosed in the document FR-A-2 817 170, to reconstitute a foam.

The process of the present invention can additionally comprise, after the stage of bringing the surface to be decontaminated into contact with the foam, a stage of rinsing the said surface using a rinsing foam or solution. The rinsing foam or solution can be any appropriate foam or solution depending on the nature of the decontamination foam and/or of the surface to be rinsed. It can be simply a conventional rinsing foam or a rinsing foam in accordance with the present invention, that is to say comprising simply a surfactant and a gelling agent and, optionally, a conventional buffer compound which makes it possible to neutralize the acidic or basic decontaminating agent used above or a compound for the treatment of the surface. It can also be an aqueous solution, for example water.

Such a treatment, by "gelled foam", in accordance with the present invention has many advantages in comparison with the existing treatments.

First, the conventional advantages of foam treatment apply, that is to say in particular the reduction in the volume of effluents produced. This is because the foam is composed of a dispersion of air bubbles in liquid and can be characterized by its expansion "F" defined under standard temperature and pressure conditions by the following relationship (1):

$$F=(V_{gas}+V_{liquid})/V_{liquid}=V_{foam}/V_{liquid}$$

in which V represents a volume of liquid, of gas or of foam as is indicated.

The decontamination foams prepared from the composition of the present invention advantageously exhibit an expansion of the order of 10 to 15. They thus make it possible to decontaminate a large volume, for example of 100 $m^3$, with less than 10 $m^3$ of liquid.

Another advantage, in particular in the case of decontamination by spraying gelled foam over surfaces of radioactive plants, is that the gelled foam of the present invention produces smaller amounts of radioactive effluents as a result of its long lifetime, whereas spraying foams or aqueous solutions of the prior art produces large amounts of radioactive effluents for a limited effectiveness due to the low contact time with the surfaces treated.

Another advantage of the present invention lies in the fact that, following the natural draining of the foam of the present invention, the contaminated drained liquid is recovered and the surface only has to be rinsed with a very small amount of water, that is to say approximately 1 liter/$m^2$. Thus, less liquid effluent to be treated is generated subsequently. This results in a simplification in terms of overall procedure for the treatment of the contamination and a decrease in the pollution.

Other characteristics and advantages of the present invention will become more apparent on reading the following examples, given, of course, by way of illustration and without limitation, with reference to the appended figures.

EXAMPLES

Example 1

Foams of the Prior Art

The draining and effectiveness properties of foams prepared from five foaming solutions each comprising a reference mixture of two surfactants: Oramix (trade mark) at 8 g/l and Amoyl (trade mark) at 3 g/l, were studied.

One formulation, referred to as reference formulation (allowing the generation of a reference foam), did not comprise decontaminating agent.

The other four formulations differ in the nature of the decontaminating agent:

1st formulation: sodium carbonate at a concentration of 1 $mol.l^{-1}$,

2nd formulation: a mixture of hydrofluoric acid at a concentration of 0.05 mol.l$^{-1}$ and of nitric acid at a concentration of 2 mol.l$^{-1}$, 3rd formulation: a mixture of oxalic acid at a concentration of 0.6 mol.l$^{-1}$ and of nitric acid at a concentration of 0.5 mol.l$^{-1}$, 4th formulation: a mixture of hydrogen peroxide at a concentration of 1 mol.l$^{-1}$ and of nitric acid at a concentration of 3 mol.l$^{-1}$.

No cloud point was observed between 20 and 50° C.

These foaming solutions were subsequently used to generate foams of controlled expansion using a glass bend static generator (Ql=foaming solution flow rate, Qg=air flow rate, F=(Qg+Ql)/Ql).

Figure 1:
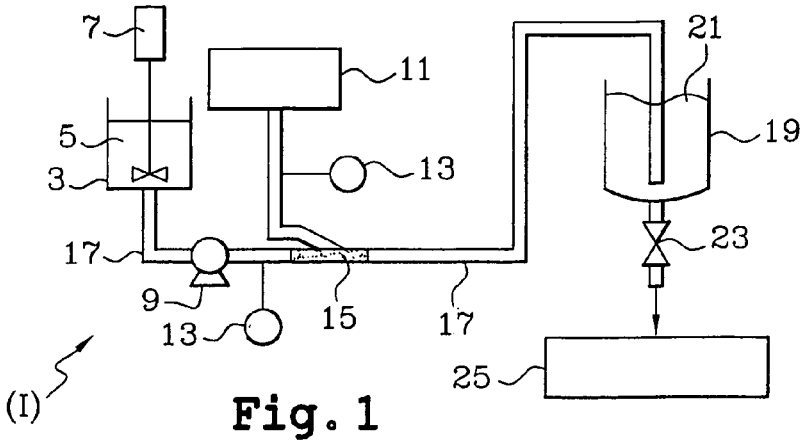
FIG. 1 is a diagrammatic representation of the device used by the inventors to generate a foam from an aqueous solution of the composition of the present invention and to measure drainage kinetics of the foam obtained.

An experimental protocol was developed to plot the drainage kinetics of each of the foams under conditions close to industrial reality by virtue of the device (I) represented diagrammatically in FIG. 1. In this figure, the following references indicate the following components of the device (I):

(3): vessel for preparing the foaming solution; (5): foaming solution; (7): mechanical stirrer; (9) pump; (11): system for supplying compressed air; (13): flow rate controller; (15): foam generator; (17) pipes; (19): vessel for receiving the foam; (21): foam; (23): manual valve; and (25): tank for recovering the drained liquid.

Each of the five formulations exhibits excellent foamability since foams with an expansion of greater than 10 were prepared.

Figure 2:
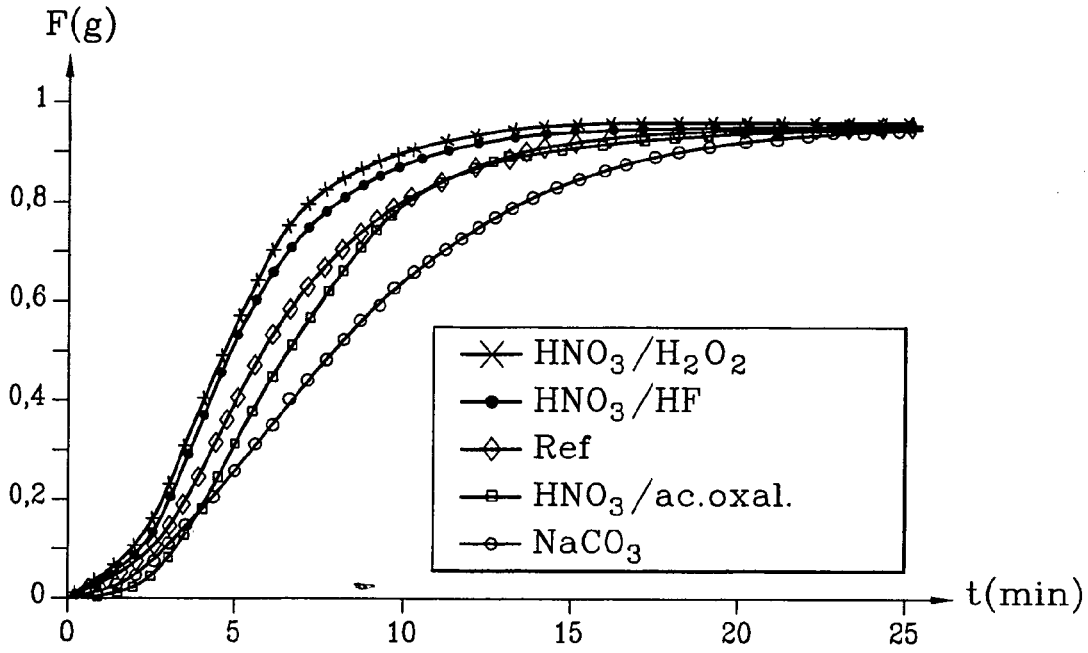
FIG. 2 is a graph illustrating drainage kinetics, expressed in fractions (F) of liquid recovered (in g) as a function of time (t) (in minutes), for various foams obtained from various compositions of the present invention.

It emerges from the kinetic studies that the presence of the decontaminating agents does not modify or only very slightly modifies the drainage kinetics in comparison with the reference foam without decontaminating agent, as is shown in FIG. 2.

Over all the formulations prepared, more than half the liquid drains in less than 8 minutes and the lifetimes of each of the formulations remain short (15 to 25 minutes).

Example 2

Foams of the Present Invention

Figure 3:
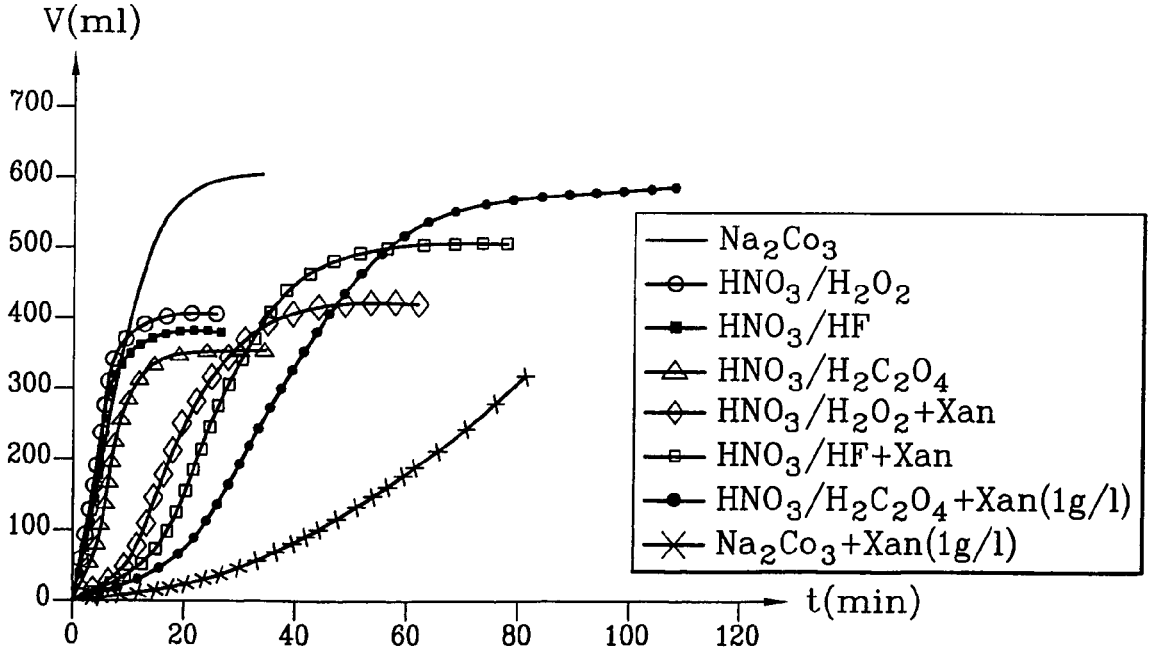
FIG. 3 is a graph illustrating drainage kinetics, expressed in volumes (V) of drained liquid (in ml) as a function of time (t) (in minutes), for various foams obtained, on the one hand, from the various compositions of the present invention and, on the other hand, from compositions without gelling agent.

The addition of a small amount, that is to say of 0.1% by weight or 1 g/l, of xanthan gum, used as gelling agent within the meaning of the present invention, to the various foaming solution formulations of Example 1 stabilizes all the foams, as is shown in FIG. 3.

The addition of 1 g/l of xanthan gum has the effect of considerably slowing down the draining of each of the foam formulations and of thus increasing the lifetime of the foam.

The time $t_{1/2}$ necessary for half the liquid present in the foam to drain and the lifetime $t_1$, time for all the liquid of the foam to drain, are collated in Table 1 below for the various foams studied.

TABLE 1

Lifetime $t_1$ and time $t_{1/2}$ for various foam formulations

| | Without xanthan gum | | 1 g/l of xanthan gum | |
|---|---|---|---|---|
| Lifetime t and half life $t_{1/2}$ (in min and s) | $t_{1/2}$ | $t_1$ | $t_{1/2}$ | $t_1$ |
| Nitric acid + hydrogen peroxide foam | 4'30" | 15' | 18' | 50' |
| Nitric acid + hydrofluoric acid foam | 4'30" | 15' | 24' | 60' |

TABLE 1-continued

Lifetime $t_1$ and time $t_{1/2}$ for various foam formulations

| | Without xanthan gum | | 1 g/l of xanthan gum | |
|---|---|---|---|---|
| Nitric acid + oxalic acid foam | 6' | 20' | 36' | 80' |
| Alkaline foam with sodium carbonate | 7'30" | 25' | 90' | >120' |

With an amount of xanthan gum of 1 g/l, the time $t_{1/2}$ is approximately 20 minutes for the two acidic formulations comprising hydrogen peroxide and hydrofluoric acid. The foam comprising oxalic acid is the most stable of the acidic foams, with a time $t_{1/2}$ of close to 40 minutes. Finally, the alkaline foam drains very slowly since close to one and a half hours are required to recover half the liquid.

These results show that the addition of a small amount of xanthan gum, of 0.1% by weight or 1 g/l, stabilizes all the formulations of Example 1.

This is because very substantial gains with regard to the stability of the formulations are obtained since lifetimes of between 50 and 120 minutes could be observed from the simple addition of a small amount of xanthan gum.

Tests have been carried out to demonstrate the connection between the amount of gelling agent and the lifetime of the foam.

Figure 5:
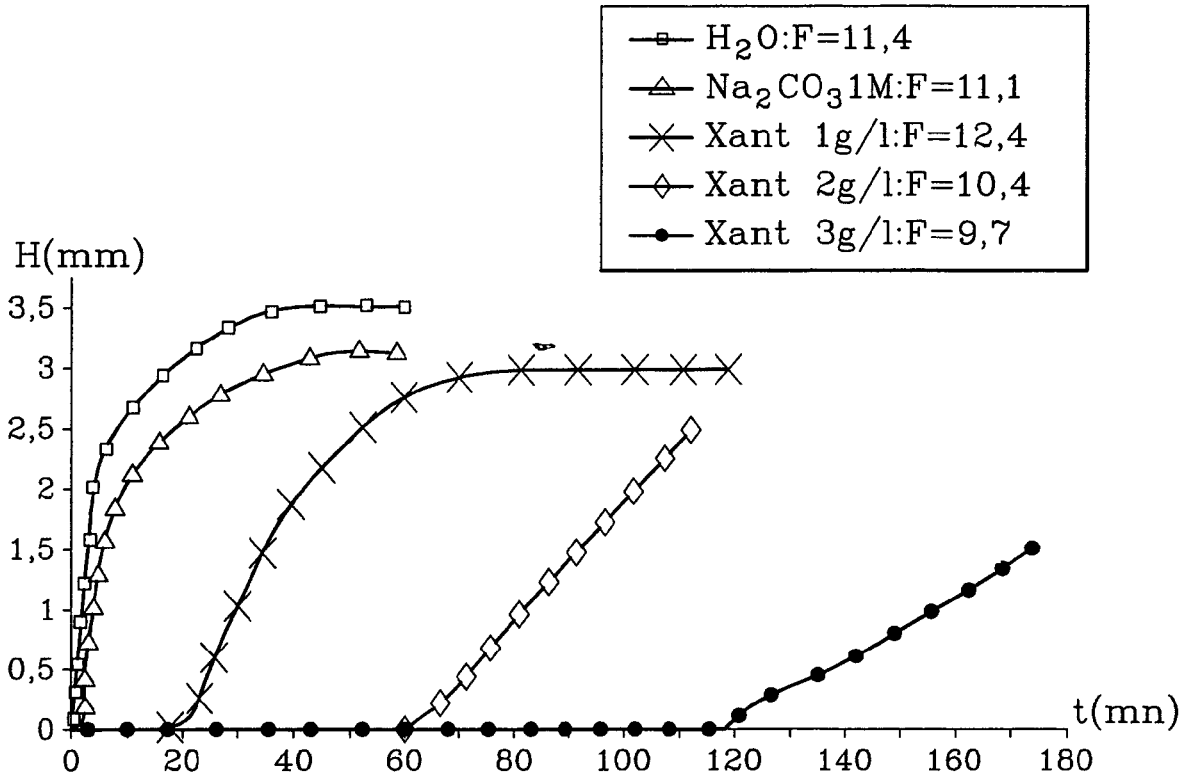
FIG. 5 is a graph illustrating the influence of the amount of xanthan gum (Xant) (in g/l) on the delay in the draining (stability of the foam): height of liquid drained (H) (in mm) as a function of the time (t) (in minutes). In this figure, the key indicates the various foaming solutions tested and F denotes the expansion of each foam obtained.

FIG. 5 is a graph illustrating the influence of the amount of xanthan gum on the delay in the draining (stability of the foam).

As long as a liquid does not drain, the foam is stable. The foam does not drain for 20 minutes for 1 g/l of xanthan gum, 60 minutes for 2 g/l of xanthan gum and 120 minutes for 3 g/l of xanthan gum. It is also apparent, on this graph, that the foaming solutions without gelling agent drain immediately (t=0 minute).

Example 3

Treatment of a Surface with Foams of the Present Invention

The effectiveness of the foams of Example 2 was furthermore tested for the decontamination of surfaces.

This is because the object is to demonstrate that the foams prepared with the foaming solutions of the present invention can, for example, dissolve a reconstituted deposit of insoluble materials simulating a true irradiating deposit adhering to a wall.

Figure 4:
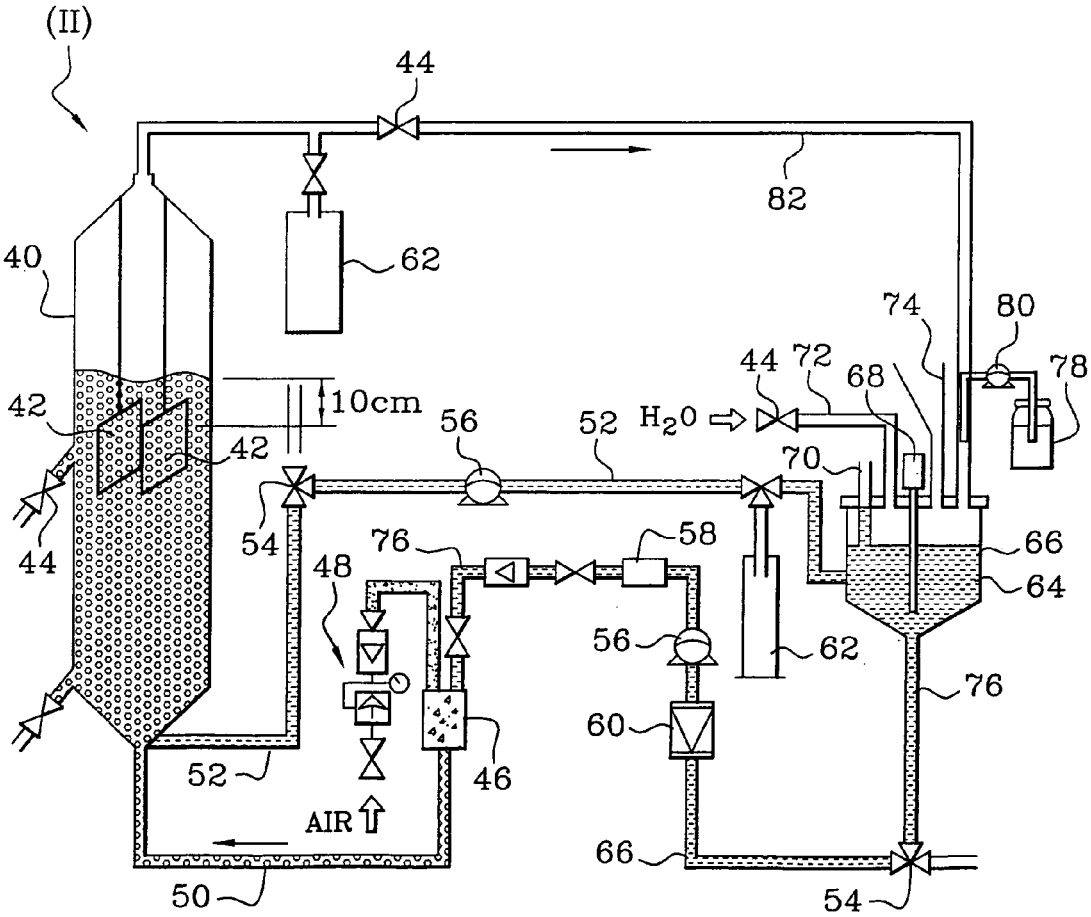
FIG. 4 is a diagrammatic representation of the device used by the inventors to generate a foam from a composition of the present invention and to carry out a process for the decontamination of a surface according to the present invention.

Stainless steel plates covered with adherent deposits are suspended in a 30 liter column made of plexiglass in the device (II) represented diagrammatically in FIG. 4. In this figure, the following references indicate the following components of the device (II):

(40): plexiglass column; (42): suspended steel plate; (44): valve; (46) glass bead bed foam generator; (48): system for introducing compressed air; (50): pipe for conveying the foam generated to the column (40); (52): pipe for recovering the draining liquid; (54) valve; (56): pump; (58): pulsation damper; (60): filter; (62): withdrawal pipe; (64): reactor for the preparation of the foaming solution; (66): foaming solution; (68): mechanical stirrer; (70): thermometer; (72): water feed pipe; (74): pipe for feeding the foaming solution with compound; (76): pipe for feeding the foam generator (46)

with foaming solution; (78): alcohol reservoir; (80): alcohol metering pump; (82): pipe for recovering the foam.

The two plates (42) covered with the deposit to be dissolved are deliberately placed at the centre of the column. The column is filled until the samples are completely immersed and generation is halted when the topmost edge of each of the two plates is at a depth of 10 cm in the foam. This level of foam corresponds to 20 liters of foam and is intentionally limited in order to quantify the effectiveness of the top part of the foam.

The slight immersion of the plates is disadvantageous since the foam dries up from the top under the effect of gravitational draining. The foam/deposit contact times are then shorter and may prove to be inadequate to provide effective dissolution. However, if the dissolution proves to be significant in the top part of the foam, it will be even more significant within the foam.

The stopwatch is started when the column has been filled with 20 liters of foam and the foam is allowed to act statically. The sample is withdrawn after a given time in order to evaluate, by weighing, the dissolution of the deposit. If two samples have been positioned, one can be withdrawn after immersing for one hour, for example, and the other after two hours.

To carry out these deposit dissolution experiments, the foams are obtained successively in the following way. 4 liters of a solution comprising one of the three reactants, the surfactants and the xanthan gum are prepared. The solution is placed with stirring in the reactor (64) thermostatically controlled between 20 and 50° C. A gas-liquid mixture in a known proportion is then subsequently generated through a bed of glass beads: approximately 12 liters per hour of acidic solution are mixed with a controlled gas flow of 180 liters per hour of air, to generate a relatively wet foam with a known expansion in the region of 14.

Tests in the foam phase were carried out, for example with the carbonate-comprising foaming formulation comprising 1.5 g/l of xanthan gum with the Rhodopol 23 trade mark. The lifetime of the foam is then of the order of 2 to 3 hours.

A first adherent deposit, sample 1, with a thickness of 0.5 mm, i.e. 1 g over 25 $cm^2$, is placed within the column. The object of the test is to allow a carbonate-comprising foam to act statically and to recover the sample once the foam has returned to the liquid state. The test is carried out by preheating the foaming solution to 50° C., which makes it possible to obtain a temperature within the foam of 33° C. After one hour, the temperature of the foam is 30° C. and, after two hours, 28° C. After 3 hours, the temperature is that of the laboratory (27° C.) and the carbonate-comprising foam, obtained from a 1M solution, has completely drained.

The sample, invisible at the beginning as immersed in the foam, appears completely freed from the deposit.

This very positive qualitative result justified the introduction of two thicker MoZr deposits with a thickness of approximately 1.2 mm, so as to quantify the rate of dissolution over the first two hours of the treatment. One deposit is withdrawn after 1 hour of contact with the foam and the other after 2 hours. The results are collated in Table 2 below.

It is apparent that the mass dissolved in two hours, that is to say 0.74 g or 0.71 g, is virtually double that dissolved over the first hour, that is to say 0.42 g (slightly less since the mean temperature over the second hour is lower by 3° C.).

At a mean temperature of the foam of 30° C., the rate of dissolution of a deposit of 25 $cm^2$ in contact with the foam is of the order of 0.4 g/h, or alternatively 0.2 mm/h, to be compared with the 0.8 g/h obtained in the liquid phase at 30° C. This rate of dissolution, virtually constant over the first two hours, shows, as in the case of the liquid phase, that the dissolution is uniform and homogeneous over the surface. It advantageously makes it possible to completely dissolve an irradiating deposit of 0.5 mm over 3 hours at 30° C.

This result makes it possible to envisage using, instead of a rinsing operation with sodium carbonate in the liquid phase, a rinsing operation in the foam phase according to the invention, which makes it possible to reduce the amount of sodium used, which is disadvantageous for the subsequent formation of the containment glasses.

TABLE 2

Losses in weight of an MoZr deposit in contact with a static foam comprising sodium carbonate (1 M)

| Sample | Immersion time in the foam | Temperature | Weight of initial deposit (25 $cm^2$) in g | Loss in weight during the immersion time (g) |
|---|---|---|---|---|
| 2 | 1 hour | 1 h from 33° C. to 30° C. | 2.4 | 0.42 |
| 3 | 2 hours | 1 h from 33° C. to 30° C. 1 h from 30° C. to 28° C. | 2.49 | 0.74 |
| 3 | 1 additional hour (48 h afterwards) | 1 h from 36° C. to 30° C. | 1.75 | 0.49 |
| 3 | 2 additional hours | 2 h from 35° C. to 28° C. | 1.26 | 0.71 |

The invention claimed is:

1. Process for the radioactive decontamination of a surface, which involves bringing the surface to be decontaminated into contact with a foam prepared with an aqueous solution which comprises, per liter of solution:

0.2 to 2% by weight of a foaming organic surface-active agent or of a mixture of foaming surface-active agents, from 0.1 to 1.5% by weight of a gelling agent, wherein the gelling agent is an organic thickening agent exhibiting a rheological behaviour of pseudoplastic type, and, optionally, 0.2 to 7 mol of an inorganic acid or oxalic acid or inorganic base for radioactive decontamination or of a mixture of inorganic acids or inorganic acid(s) and oxalic acid or of inorganic bases for radioactive decontamination.

2. Process according to claim 1, in which the surface-active agent is a foaming nonionic surfactant.

3. Process according to claim 1, in which the surface-active agent is a foaming nonionic surfactant chosen from the family of the alkylpolyglucosides or alkylpolyetherglucosides.

4. Process according to claim 1, in which the surface-active agent is an amphoteric surfactant.

5. Process according to claim 1, in which the surface-active agent is an amphoteric surfactant chosen from the family of the sulphobetaines, from the family of the alkyl amidopropyl hydroxysulphobetaines or from the family of the amine oxides.

6. Process according to claim 1, in which the acid is chosen from the group consisting of hydrochloric acid, nitric acid, sulphuric acid, phosphoric acid and oxalic acid or is a mixture of acids from this group.

7. Process according to claim 1, in which the acid is in an amount of 0.3 to 7 mol.

8. Process according to claim 1, in which the acid is in an amount of 1 to 4 mol.

9. Process according to claim 1, in which the base is chosen from the group consisting of sodium hydroxide, potassium hydroxide and sodium carbonate or is a mixture of bases from this group.

10. Process according to claim 1, in which the base is in an amount of less than 2 mol.

11. Process according to claim 1, in which the base is in an amount of 0.5 to 1.5 mol.

12. Process according to claim 1, in which the gelling agent is chosen from the group consisting of a water-soluble polymer, a hydrocolloid and a heteropolysaccharide or from the group consisting of cellulose derivatives.

13. Process according to claim 1, in which the gelling agent is chosen from the group consisting of heteropolysaccharides chosen from the family of the polyglucoside polymers comprising trisaccharide branched chains; and cellulose derivatives, such as carboxymethylcellulose or a polysaccharide comprising glucose as sole monomer.

14. Process according to claim 1, in which the gelling agent is xanthan gum.

15. Process according to claim 1, in which the surface to be decontaminated is brought into contact with the foam for 1 to 10 hours.

16. Process according to claim 15, additionally comprising, after the operation of bringing the surface to be decontaminated into contact with the foam, rinsing the surface using a rinsing solution.

* * * * *